US010483611B2

(12) United States Patent
Sugano

(10) Patent No.: US 10,483,611 B2
(45) Date of Patent: Nov. 19, 2019

(54) WAVEGUIDE/TRANSMISSION LINE CONVERTER CONFIGURED TO FEED A PLURALITY OF ANTENNA ELEMENTS IN AN ANTENNA DEVICE

(71) Applicant: Japan Radio Co., Ltd., Tokyo (JP)

(72) Inventor: Masayuki Sugano, Tokyo (JP)

(73) Assignee: Japan Radio Co., Ltd., Tokyo (JP)

( * ) Notice: Subject to any disclaimer, the term of this patent is extended or adjusted under 35 U.S.C. 154(b) by 0 days.

(21) Appl. No.: 15/560,396

(22) PCT Filed: Mar. 18, 2016

(86) PCT No.: PCT/JP2016/058847
§ 371 (c)(1),
(2) Date: Sep. 21, 2017

(87) PCT Pub. No.: WO2016/152811
PCT Pub. Date: Sep. 29, 2016

(65) Prior Publication Data

US 2018/0069286 A1 Mar. 8, 2018

(30) Foreign Application Priority Data

Mar. 23, 2015 (JP) ..... 2015-058860
Feb. 1, 2016 (JP) ..... 2016-016965

(51) Int. Cl.
*H01P 5/107* (2006.01)
*H01Q 13/08* (2006.01)
(Continued)

(52) U.S. Cl.
CPC ..... *H01P 5/107* (2013.01); *H01Q 13/08* (2013.01); *H01Q 21/0006* (2013.01); *H01Q 21/06* (2013.01); *H01Q 21/065* (2013.01)

(58) Field of Classification Search
CPC ..... H01P 5/107
(Continued)

(56) References Cited

U.S. PATENT DOCUMENTS 6,580,335 B1 6/2003 Iizuka et al.
2003/0076188 A1* 4/2003 Dawn et al. ..... H01P 5/107 333/26
(Continued)

FOREIGN PATENT DOCUMENTS

GB 2164497 A 3/1986
JP 2000-244212 A 9/2000
(Continued)

OTHER PUBLICATIONS

International Search Report dated Jun. 7, 2016 from corresponding PCT International Application PCT/JP2016/058847, 2 pages.
(Continued)

*Primary Examiner* — Benny T Lee
(74) *Attorney, Agent, or Firm* — Ohlandt, Greeley, Ruggiero & Perle, L.L.P.

(57) ABSTRACT

A metal member which allows a waveguide to extend inside a dielectric substrate and is adapted to hold a short-circuit metal layer at a potential same as a potential of the waveguide is made to remain along cross-sections of the two wide walls of the waveguide and is removed along cross-sections of two narrow walls of the waveguide so as to prevent an electromagnetic wave from unintendedly being radiated.

12 Claims, 11 Drawing Sheets

(51) Int. Cl.
*H01Q 21/06* (2006.01)
*H01Q 21/00* (2006.01)

(58) Field of Classification Search
USPC ..... 333/26
See application file for complete search history.

(56) References Cited

U.S. PATENT DOCUMENTS

2004/0155723 A1* 8/2004 Koriyama ..... H01L 23/66 333/26
2005/0200424 A1* 9/2005 Takeda et al. ..... H01P 5/107 333/26
2016/0141740 A1* 5/2016 Natsuhara et al. ..... H01P 5/107 333/239

FOREIGN PATENT DOCUMENTS

JP 2004-320460 A 11/2004
JP 2005079733 3/2005
JP 2010-273029 A 12/2010
JP 2014-195327 A 10/2014

OTHER PUBLICATIONS

International Preliminary Report on Patentability dated Oct. 5, 2017 from corresponding PCT International Application PCT/JP2016/058847, 12 pages.
Iizuka et al., "Millimeter-Wave Transition From Waveguide to Two Microstrip Lines Using Rectangular Patch Element", IEEE Transactions on Microwave Theory and Techniques, Plenum, USA, vol. 55, No. 5, May 1, 2007, pp. 899-905.
Seo et al., "Via-hole-less planar microstrip-to-waveguide transition in millimeter-wave band", Microwave Conference Proceedings (CJMW), 2011 China-Japan Joint, IEEE, Apr. 20, 2011, pp. 1-4.
Extended European Search Report dated Oct. 24, 2018 in corresponding European Patent Application No. 16768714.4, 9 pages.
First Chinese Office Action dated Mar. 21, 2019 in corresponding Chinese Patent Application No. 201680016997.7, 13 pages.

* cited by examiner

WAVEGUIDE/TRANSMISSION LINE CONVERTER CONFIGURED TO FEED A PLURALITY OF ANTENNA ELEMENTS IN AN ANTENNA DEVICE

BACKGROUND

1. Field of the Disclosure

The present disclosure relates to (1) a waveguide/transmission line converter to convert power transmitted by a waveguide and power transmitted by a transmission line to each other, and (2) an antenna device having antenna elements arranged in a lattice shape on a plane and having power fed from the waveguide/transmission line converter.

2. Discussion of the Background Art

The waveguide/transmission line converter is applied to feed power and the like to an antenna device and disclosed in, for example, Patent Literature 1 and 2. First, according to the Patent Literature 1, a transmission line is inserted at a position inside the waveguide where electric field intensity is high. However, according to the Patent Literature 1, a waveguide short-circuit surface is needed at a position distant from the transmission line along the waveguide by a distance equal to approximately ¼ of a wavelength of an electromagnetic wave inside the waveguide. Therefore, in the Patent Literature 1, the waveguide/transmission line converter cannot be reduced in size and a structure forming the waveguide short-circuit surface exists in a front direction of directivity of the antenna device, thereby causing deterioration of directivity of the antenna device.

PATENT LITERATURE

Patent Literature 1: Japanese Patent Application Laid-Open No. 2004-320460

Patent Literature 2: Japanese Patent Application Laid-Open No. 2000-244212

Technical Problem

Next, according to Patent Literature 2, utilized is a technique of coupling a transmission line to a matching element to propagate radio waves from a transmission line to a waveguide. As it can be understood from the following description, according to the Patent Literature 2, compared to Patent Literature 1, a waveguide/transmission line converter can be reduced in size, and a structure forming a short-circuit surface, which in turn causes deterioration of directivity of the antenna device, can be eliminated.

FIG. 1 illustrates a structure of a waveguide/transmission line converter in the related art. An uppermost view illustrates a side-sectional view of a waveguide/transmission line converter 1'. A second view illustrates a plan-sectional view taken along an arrow A'-A' of the waveguide/transmission line converter 1'. A third view illustrates a plan-sectional view taken along an arrow B'-B' of the waveguide/transmission line converter 1'. A lowermost view illustrates electric field distribution (along the vertical axis referencing potential "V" ranging from negative "−" to positive "+") in a resonant length direction (i.e., horizontal axis) of a matching element 17' to be described later.

The waveguide/transmission line converter 1' includes a dielectric substrate 13', a short-circuit metal layer 14', a metal member 15', a ground metal layer 16', and a matching element 17'.

The dielectric substrate 13' is arranged in a manner blocking an opening of the waveguide 11'. A surface of the dielectric substrate 13' is the surface perpendicular to a waveguide direction of the waveguide 11'. In the second and third views of FIG. 1, a portion of the dielectric substrate 13' where a pattern is arranged is indicated by a white background and a portion of the dielectric substrate 13' where no pattern is arranged is indicated by hatching.

The short-circuit metal layer 14' is arranged on a surface of the dielectric substrate 13' and outside the waveguide 11', and held at a potential same as that of the waveguide 11' by the metal member 15' penetrating the dielectric substrate 13' and the ground metal layer 16' arranged on a surface of the dielectric substrate 13' and at an outer frame of the waveguide 11'.

The matching element 17' is arranged on the surface of the dielectric substrate 13' and inside the waveguide 11' and electromagnetically coupled to the a transmission line 12' via the dielectric substrate 13', in which a resonant length (approximately $\lambda_g'/2$) adapted to set up, as a standing wave, an electromagnetic wave having an effective wavelength $\lambda_g'$ in a surrounding environment of the dielectric substrate 13' is in an electric field direction inside the waveguide 11' and in a feed power direction of the transmission line 12'.

Only one transmission line 12' is arranged in the description for FIG. 1. As a modified example, two transmission lines 12' extending in opposite directions may be arranged. However, it is not necessary to arrange two matching elements 17', and arranging only one matching element is sufficient. Additionally, the two transmission lines 12' extending in the opposite directions may share the one matching element 17'.

FIG. 2 illustrates an exemplary structure of an antenna device 2' utilizing a technique in the related art. An antenna device is not disclosed in the Patent Literatures 1 and 2. In the antenna device 2', antenna elements are arranged in a lattice shape on a plane. The antenna elements arranged in a lattice shape are divided per antenna elements 21' in each column. The antenna elements 21' in each column are fed power from two transmission lines 12' which are connected to the waveguide/transmission line converter 1' arranged in a center of each column, and extend in opposite directions (described as the modified example in the previous paragraph with reference to FIG. 1). As shown in FIG. 1, the dielectric substrate 13' is a plane on which the antenna elements are arranged in a lattice shape. A cross-section of a wide wall of the waveguide 11' is arranged in a direction perpendicular to a direction of each column. Across-section of a narrow wall of the waveguide 11' is arranged in a direction parallel to the direction of each column.

Since the antenna elements 21' in each column are fed power in the center of each column, a result of synthesizing the respective antenna elements constituting each column can form directivity having high gain in one arbitrary direction in a wide frequency range even when excitation phases of the respective antenna elements constituting each column are deviated from each other at a frequency deviated from a center frequency of the antenna device 2'.

However, a size $p_w'$ in a direction along the cross-section of the wide wall of the waveguide 11' (refer to FIG. 1, which additionally shows a size $p_N'$ in a direction along the cross-section of the narrow wall of the waveguide 11') among sizes of patterns arranged on the surface of the dielectric substrate 13' becomes inevitably large in the waveguide/transmission line converter 1'. Therefore, in the antenna device 2' of FIG. 2, a distance d' between the antenna elements 21' in respective columns adjacent to each other becomes inevitably wider than a length $\lambda_0/2$ that is equal to half a wavelength $\lambda_0$ of a radiated electromagnetic wave. Consequently, a visible region in an array antenna becomes inevitably wide, and a grating lobe is more likely to occur in directivity of the array antenna formed of the respective antenna elements constituting the respective columns, particularly at the time of adjusting phase information of respective antenna elements and performing beam scanning to a wide field of view.

SUMMARY OF THE INVENTION

Accordingly, to solve the above-described problem, the present disclosure is directed to providing: a waveguide/transmission line converter in which a size in a direction along a cross-section of a wide wall of a waveguide among sizes of patterns arranged on a surface of a dielectric substrate is reduced; and an antenna device in which a distance between antenna elements in respective columns adjacent to each other is narrowed and grating lobe is mostly eliminated in directivity of an array antenna formed of the respective antenna elements constituting the respective columns, particularly at the time of adjusting phase information of the respective antenna elements and performing beam scanning to a wide field of view.

Solution to the Problem

To achieve the above-described objects, applied is a fact that in a waveguide slot antenna, an electromagnetic wave is not radiated in the case where a slot to be provided on a narrow wall is provided in a direction parallel to the cross-section of the narrow wall, because current flowing along the narrow wall flows in a direction parallel to a cross-section of the narrow wall. In other words, a metal member which allows a waveguide to extend inside a dielectric substrate and is adapted to hold a short-circuit metal layer at a potential which is the same as a potential of the waveguide is made to remain along cross-sections of two wide walls of the waveguide and removed along cross-sections of both or a cross-section of one of two narrow walls of the waveguide so as to prevent an electromagnetic wave from unintendedly being radiated.

Specifically, the present disclosure provides a waveguide/transmission line converter adapted to convert power transmitted by a waveguide and power transmitted by a transmission line to each other, and the waveguide/transmission line converter includes: a dielectric substrate arranged in a manner blocking an opening of the waveguide; a short-circuit metal layer arranged on a surface of the dielectric substrate and outside of the waveguide, and held at a potential which is the same as a potential of the waveguide by a metal member penetrating the dielectric substrate along cross-sections of two wide walls of the waveguide or by a metal member penetrating the dielectric substrate along the cross-sections of the two wide walls and a cross-section of one of two narrow walls of the waveguide; and a matching element arranged on a surface of the dielectric substrate and inside the waveguide, and coupled to the transmission line, in which a resonant length adapted to set up, as a standing wave, an electromagnetic wave having an effective wavelength in a surrounding environment of the dielectric substrate is in an electric field direction inside the waveguide and in a feed power direction of the transmission line.

With this structure, it is possible to reduce a size in the direction along the cross-section of the wide wall of the waveguide among sizes of patterns arranged on the surface of the dielectric substrate.

Additionally, the present disclosure provides the waveguide/transmission line converter further including a dielectric layer formed on surfaces of the transmission line and the short-circuit metal layer.

With this structure, it is possible to increase an effective dielectric constant in the surrounding environment of the waveguide/transmission line converter and reduce a size of a pattern around the waveguide/transmission line converter.

Furthermore, the present disclosure provides the waveguide/transmission line converter wherein the dielectric layer has a thickness of 0.2 times or less of an effective wavelength of an electromagnetic wave in the surrounding environment of the waveguide/transmission line converter.

With this structure, in order to cover a region where an electric field may leak from the dielectric substrate between the transmission line and the matching element, the dielectric layer is required to have only a minimal thickness.

Moreover, the present disclosure provides the waveguide/transmission line converter wherein a plurality of the transmission lines extend in at least one of two directions away from the waveguide/transmission line converter along a resonant length direction of the matching element.

With this structure, it is possible to achieve an antenna array in a direction perpendicular to a feed power direction with only one waveguide/transmission line converter, and high degree of freedom is provided to the performance of an array antenna.

Furthermore, the present disclosure provides an antenna device having antenna elements arranged in a lattice shape on a plane, wherein the antenna elements arranged in a lattice shape are divided per antenna elements arranged in each column, power is fed to the antenna elements arranged in each column by the transmission line connected to a waveguide/transmission line converter arranged in a center of each column, the dielectric substrate is a plane on which the antenna elements are arranged in a lattice shape, a cross-section of a wide wall of the waveguide is arranged in a direction perpendicular to each column, a cross-section of a narrow wall of the waveguide is arranged in a direction parallel to each column.

With this structure, a distance between the antenna elements in respective columns adjacent to each other is narrowed, and a grating lobe can be mostly eliminated in directivity of the array antenna formed of the respective antenna elements constituting the respective columns, particularly at the time of adjusting phase information of respective antenna elements and performing beam scanning to a wide field of view.

Thus, according to the present disclosure, provided are: the waveguide/transmission line converter in which the size in a direction along the cross-section of the wide wall of the waveguide out of the sizes of the patterns arranged on the surface of the dielectric substrate is reduced; and the antenna device in which the distance between the antenna elements in the respective columns adjacent to each other is narrowed, and a grating lobe can be mostly eliminated in directivity of the array antenna formed of the respective antenna elements constituting the respective columns, particularly at the time of adjusting phase information of respective antenna elements and performing beam scanning to a wide field of view.

DETAILED DESCRIPTION OF THE PREFERRED EMBODIMENT

Embodiments of the present disclosure will be described with reference to the attached drawings. The embodiments described below are working examples of the present disclosure, and the present disclosure is not limited to the following embodiments. These working examples are merely examples, and the present disclosure can be implemented in a mode having various modifications and improvements based on knowledge of those skilled in the art. Note that constituent elements denoted by a same reference sign in the present specification and drawings indicate identical constituent elements.

First Embodiment

Figure 3A:
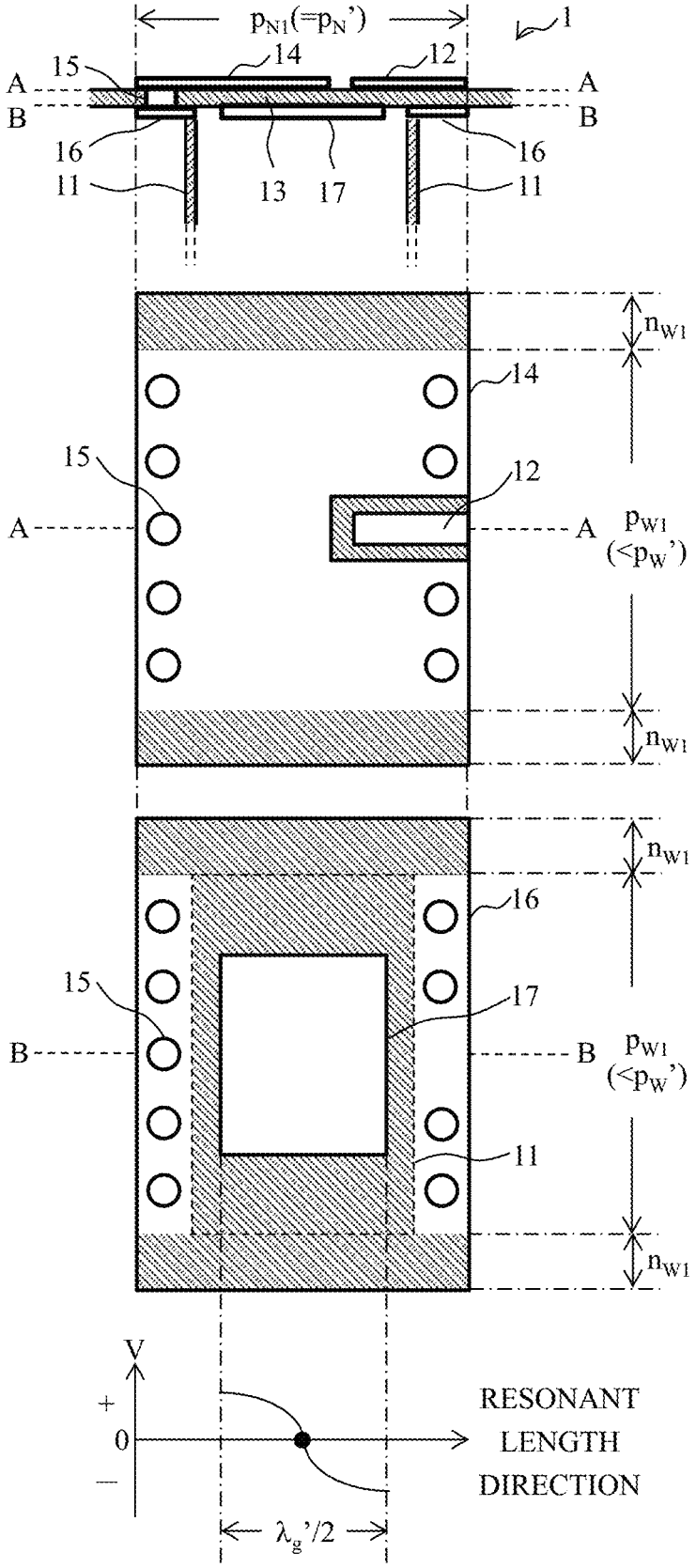
FIG. 3*a* is a diagram illustrating a structure of a waveguide/transmission line converter according to a first embodiment.

FIG. 3*a* illustrates a structure of a waveguide/transmission line converter according to a first embodiment. An uppermost view illustrates a side-sectional view of a waveguide/transmission line converter 1. A second view illustrates a plan-sectional view taken along an arrow A-A of the waveguide/transmission line converter 1. A third view illustrates a plan-sectional view taken along an arrow B-B of the waveguide/transmission line converter 1. A lowest view illustrates electric field distribution (along the vertical axis referencing potential "V" ranging from negative "−" to positive "+") in a resonant length direction (i.e., horizontal axis) of a matching element 17 to be described later.

The waveguide/transmission line converter 1 includes a dielectric substrate 13, a short-circuit metal layer 14, a metal member 15, a ground metal layer 16, and the matching element 17.

The dielectric substrate 13 is arranged in a manner blocking an opening of a waveguide 11. A surface of the dielectric substrate 13 is the surface perpendicular to a waveguide direction of the waveguide 11. In the second and third views of FIG. 3*a*, a portion of the dielectric substrate 13 where a pattern is arranged is indicated by a white background, and a portion of the dielectric substrate 13 where no pattern is arranged is indicated by hatching.

The short-circuit metal layer 14 is arranged on a surface of the dielectric substrate 13 and outside the waveguide 11, and held at a potential same as that of the waveguide 11 by the metal member 15 penetrating the dielectric substrate 13 along cross-sections of two wide walls of the waveguide 11 and the ground metal layer 16 arranged on a surface of the dielectric substrate 13 and at an outer frame of the waveguide 11. In other words, the metal member 15 and the ground metal layer 16, which allow the waveguide 11 to extend inside the dielectric substrate 13 and are adapted to hold the short-circuit metal layer 14 at the potential same as that of the waveguide 11, are made to remain along the cross-sections of the two wide walls of the waveguide 11 and removed along cross-sections of two narrow walls of the waveguide 11 so as to prevent an electromagnetic wave from unintendedly being radiated.

The matching element 17 is arranged on the surface of the dielectric substrate 13 and inside the waveguide 11 and electromagnetically coupled to a transmission line 12 via the dielectric substrate 13, in which a resonant length (approximately $\lambda_g'/2$) adapted to set up, as a standing wave, an electromagnetic wave having an effective wavelength $\lambda_g'$ in a surrounding environment of the dielectric substrate 13 is in an electric field direction inside the waveguide 11 and in a feed power direction of the transmission line 12.

Here, the matching element 17 and the transmission line 12 exist in separate layers. Additionally, an end shape of the transmission line 12 is a stub provided with a cut-away portion or a slot. Therefore, the matching element 17 and the transmission line 12 can achieve electromagnetic coupling.

Figure 3B:
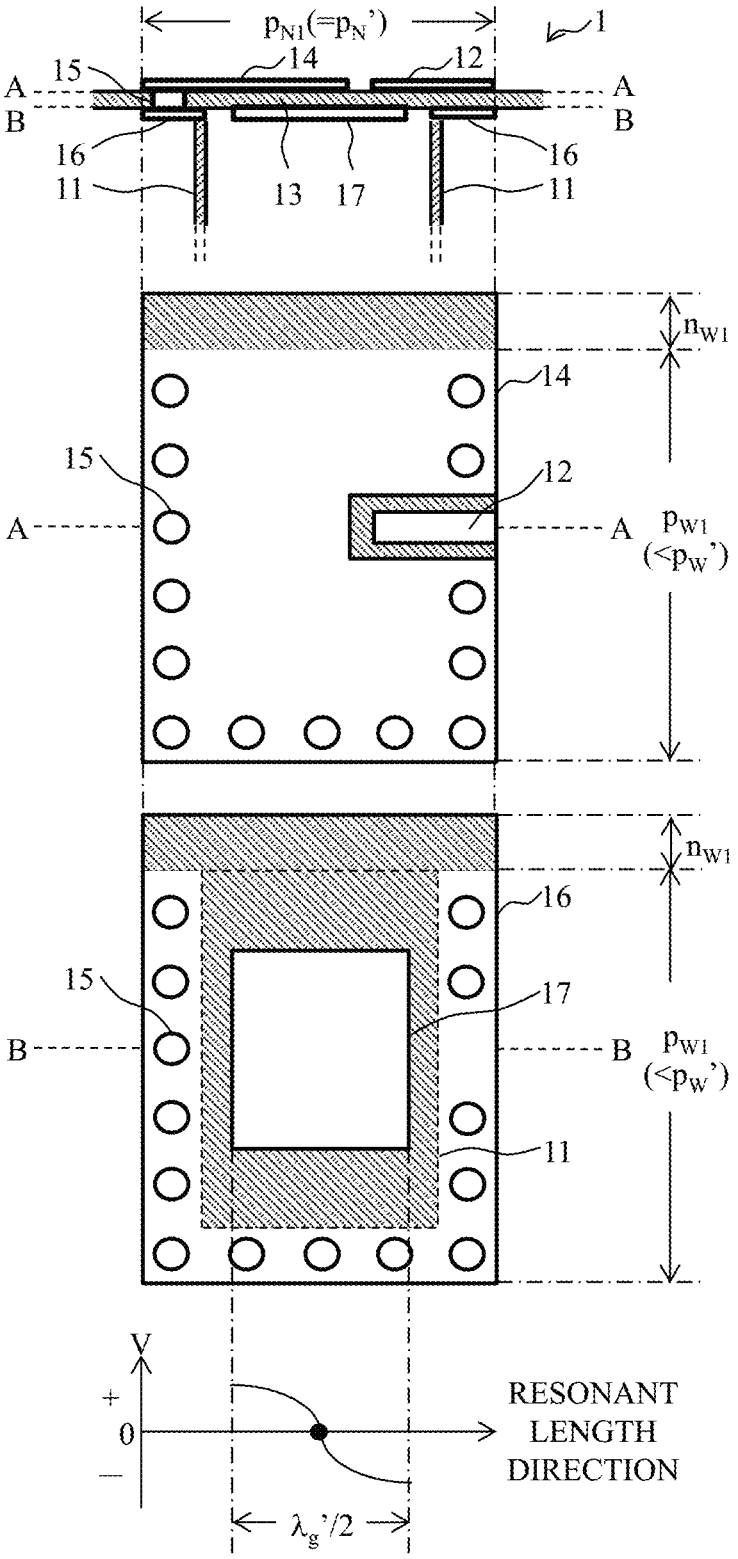
FIG. 3*b* is a diagram illustrating a structure of a waveguide/transmission line converter according to another embodiment.

In the description for FIGS. 3*a* and 3*b*, the metal member 15 is formed as a "through hole" penetrating the dielectric substrate 13 along the cross-sections of the two wide walls of the waveguide 11. As a first modified example, the metal member 15 may be a "conductor wall" penetrating the dielectric substrate 13 along the cross-sections of the two wide walls of the waveguide 11. As a second modified example, as shown in FIG. 3*b*, the metal member 15 may be formed as a "through hole" penetrating the dielectric substrate 13 along the cross-sections of the two wide walls and a cross-section of one of two narrow walls of the waveguide 11. As a third modified example, the metal member 15 may be a "conductor wall" penetrating the dielectric substrate 13 along the cross-sections of the two wide walls and the cross-section of one of the two narrow walls of the waveguide 11.

In the description for FIGS. 3*a* and 3*b*, only one transmission line 12 is arranged. As a modified example, two transmission lines 12 extending in opposite directions may be arranged. However, it is not necessary to arrange two matching elements 17, and arranging only one matching element is sufficient. Then, the two transmission lines 12 extending in the opposite directions may share one matching element 17.

Figure 4:
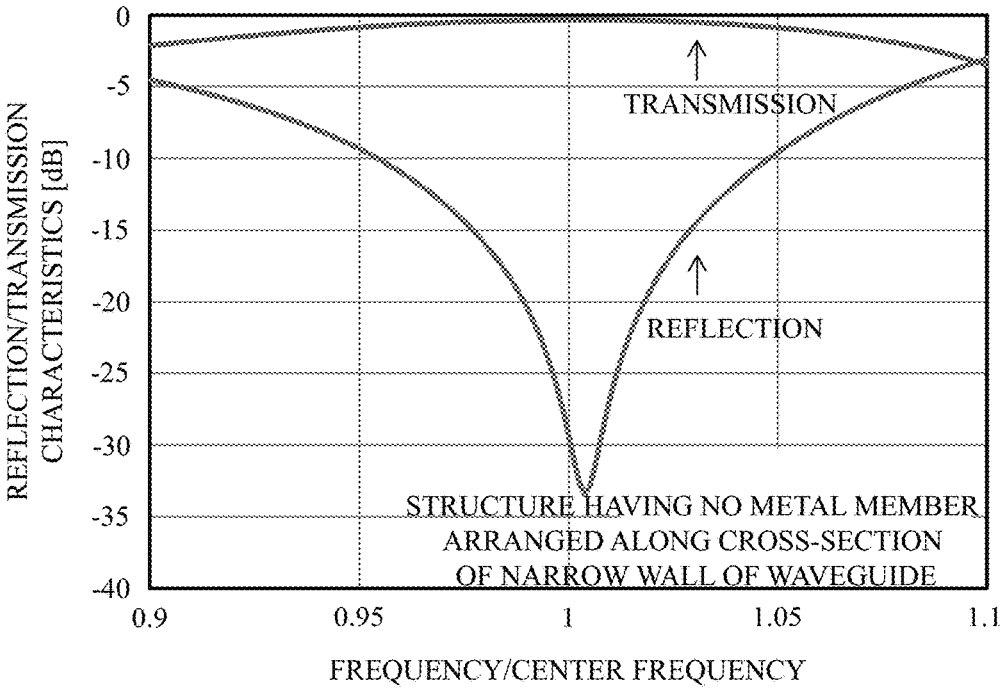
FIG. 4 is a diagram illustrating characteristics of the waveguide/transmission line converter according to the first embodiment.

FIG. 4 illustrates characteristics of the waveguide/transmission line converter according to the first embodiment. In FIG. 4, reflection and transmission characteristics (in decibels, dB) are plotted along the vertical axis, and the frequency deviation from the center frequency (represented by 1) is plotted along the horizontal axis. The transmission characteristic line and the reflection characteristic line are shown in FIG. 4 for a structure having no metal member 15 arranged along the cross-section of the narrow wall of the waveguide 11. Thus, according to the first embodiment, in a manner similar to the related art, a low reflection characteristic and a high transmission characteristic can be achieved even in a frequency deviated from a center frequency of the waveguide/transmission line converter by a bandwidth.

Figure 1:
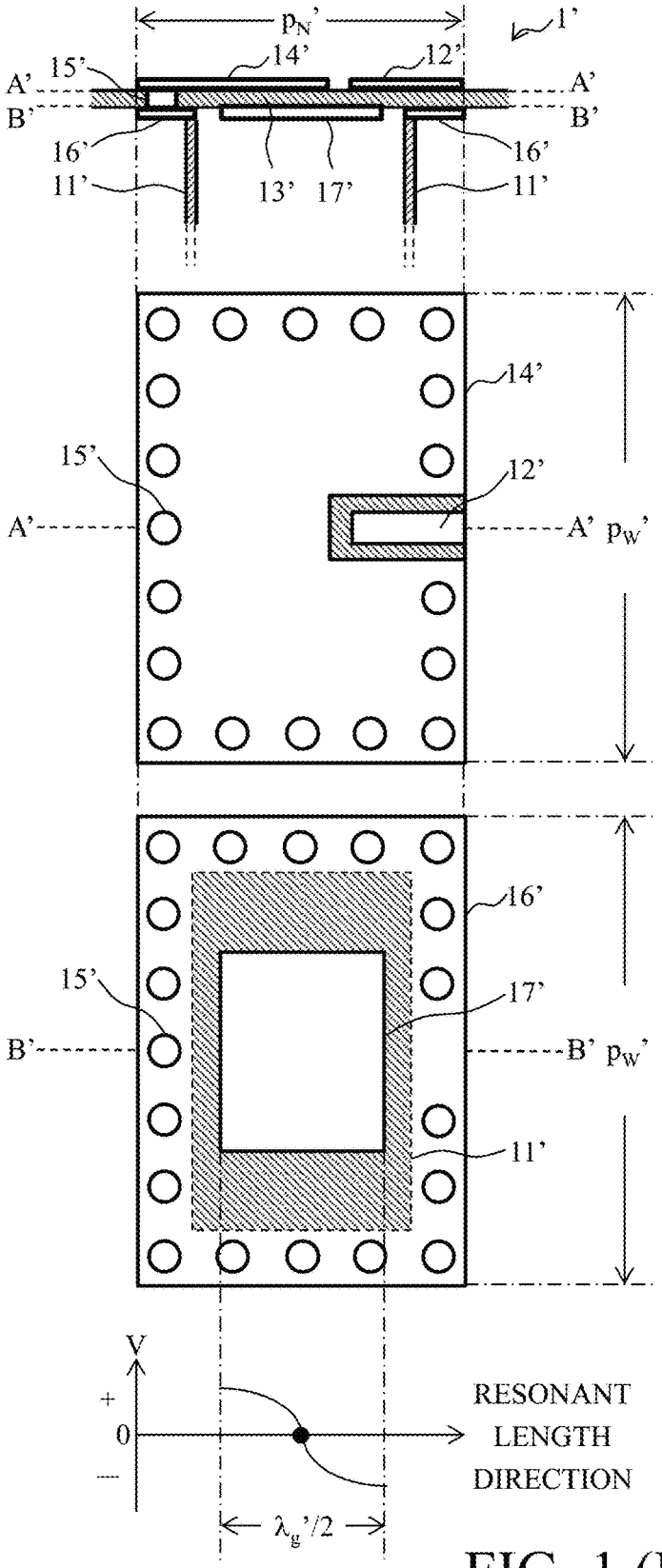
FIG. 1 (Prior Art)
FIG. 1 is a diagram illustrating a structure of a waveguide/transmission line converter in the related art.
Figure 2:
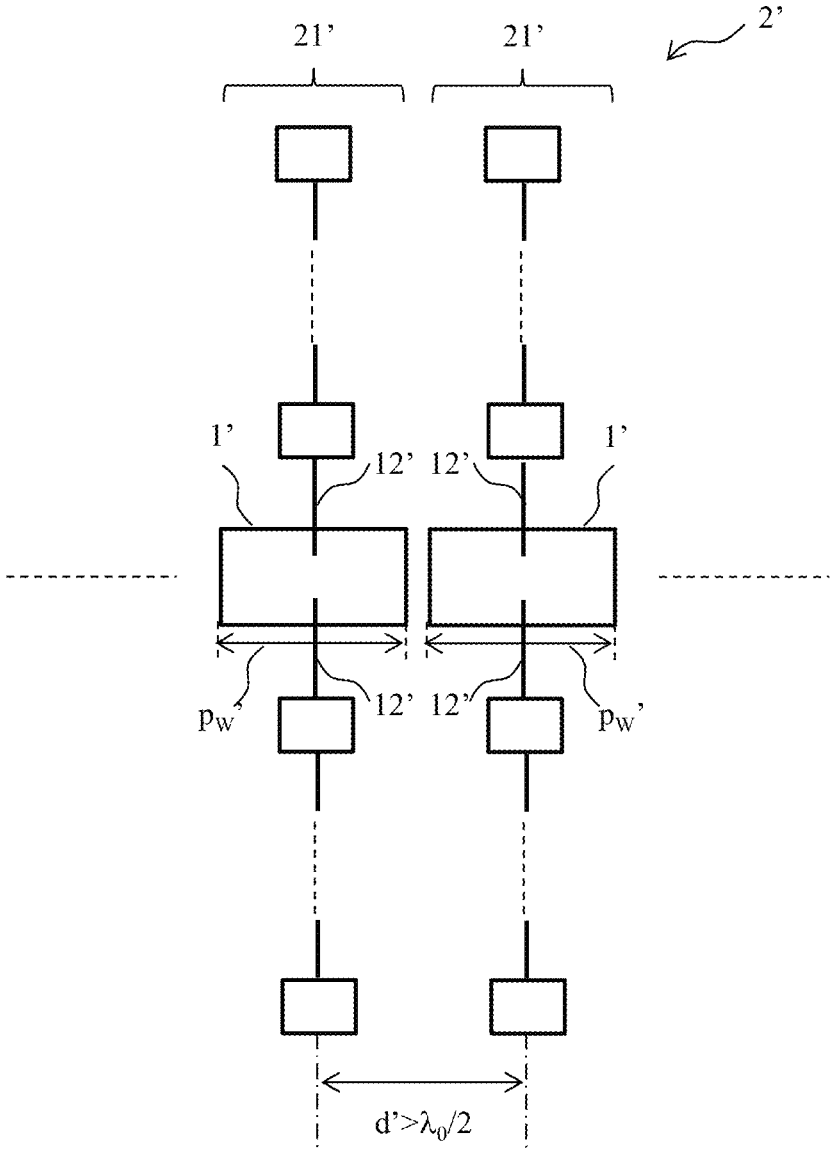
FIG. 2 (Prior Art)
FIG. 2 is a diagram illustrating an exemplary structure of an antenna device utilizing a technique in the related art.

Additionally, according to the example embodiments, compared to the related art, a size $p_{W1}$ (refer to FIGS. 3*a* and 3*b*) in a direction along the cross-section of the wide wall of the waveguide 11 among sizes of patterns arranged on the surface of the dielectric substrate 13 can be reduced by a removal width $2n_{W1}$ or $n_{W1}$ (refer to FIGS. 3*a* and 3*b*, which additionally show a size $p_{N1}$ in a direction along the cross-section of the narrow wall of the waveguide 11) of the metal member 15 and the ground metal layer 16 which have been removed along the cross-sections of both or the cross-section of one out of the two narrow walls of the waveguide 11. Specifically, compared to the size $p_W'$ in FIG. 1, the size $p_{W1}$ in FIG. 3*a* is about ⅔ of the size $p_w'$ (i.e., $<p_w'$) for millimeter wave applications in which the size of the metal member 15 cannot be ignored.

Figure 5:
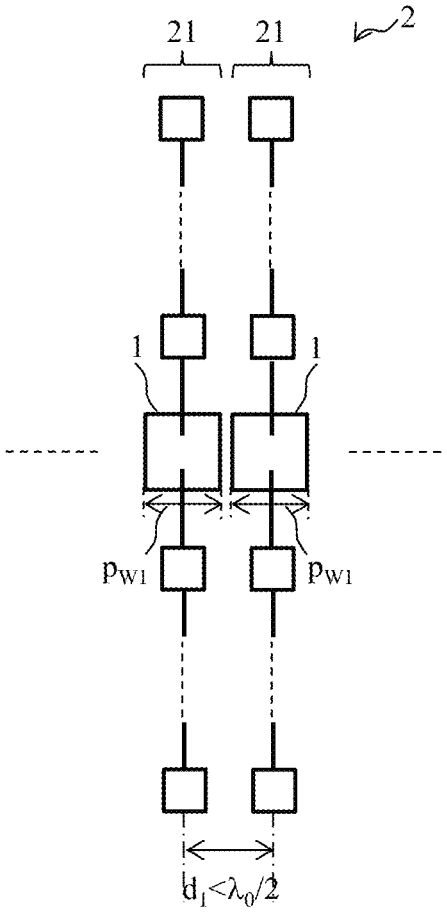
FIG. 5 is a diagram illustrating a structure of an antenna device according to the first embodiment.
Figure 6:
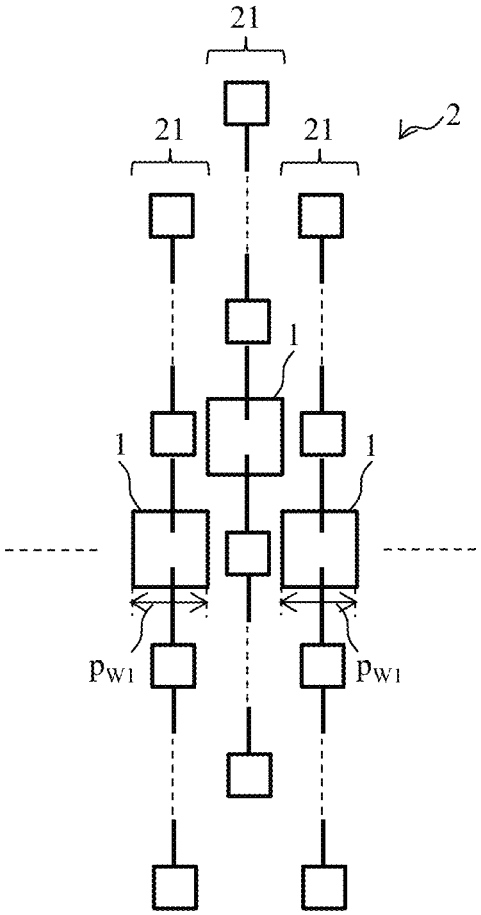
FIG. 6 is a diagram illustrating a structure of the antenna device according to the first embodiment.

FIGS. 5 and 6 illustrate structures of an antenna device according to the first embodiment. In the antenna device 2, the antenna elements are arranged in a lattice shape on a plane. In FIG. 5, the waveguide/transmission line converter 1 is arranged on a straight line in a horizontal direction of the drawing. In FIG. 6, the waveguide/transmission line converter 1 is arranged in a staggered manner in the horizontal direction of the drawing. The antenna elements arranged in a lattice shape are divided per antenna elements 21 in each column. The antenna elements 21 in each column are fed power from two transmission lines 12 which are connected to the waveguide/transmission line converter 1 arranged in a center of each column and extend in opposite directions (described as the modified example two paragraphs before). The dielectric substrate 13 is a plane on which the antenna elements are arranged in a lattice shape. The cross-section of the wide wall of the waveguide 11 is arranged in a direction perpendicular to a direction of each column. The cross-section of the narrow wall of the waveguide 11 is arranged in a direction parallel to the direction of each column.

Since the antenna elements 21 in each column have power fed in the center of each column, a result of synthesizing the respective antenna elements constituting each column can form directivity having high gain in one arbitrary direction in a wide frequency range even when excitation phases of the respective antenna elements constituting each column are deviated from each other at a frequency deviated from a center frequency of the antenna device 2.

Additionally, in the waveguide/transmission line converter 1, the size $p_{W1}$ (refer to FIGS. 3*a* and 3*b*) in the direction along the cross-section of the wide wall of the waveguide 11 (refer to FIGS. 3*a* and 3*b*) among sizes of the patterns arranged on the surface of the dielectric substrate 13 can be reduced by a removal width $2n_{W1}$ or $n_{W1}$ (refer to FIGS. 3*a* and 3*b*) of the metal member 15 and the ground metal layer 16 which have been removed along the cross-sections of both or the cross-section of one of the two narrow walls of the waveguide 11. Specifically, compared to the size $p_W'$ in FIG. 1, the size $p_{W1}$ in FIG. 3*a* is about ⅔ of the size $p_w'$ (i.e., $<p_w'$) for millimeter wave applications in which the size of the metal member 15 cannot be ignored.

Therefore, in the antenna device 2, as evident from FIG. 5, a distance $d_1$ between the antenna elements 21 in the respective columns adjacent to each other can be made narrower than a length $\lambda_0/2$ that is equal to half a wavelength $\lambda_0$ of a radiated electromagnetic wave, a visible region in an array antenna can be narrowed, and a grating lobe is mostly eliminated in directivity of the array antenna formed of the respective antenna elements constituting the respective columns, particularly at the time of adjusting phase information of the respective antenna elements and performing beam scanning to a wide field of view.

Second Embodiment

Figure 7:
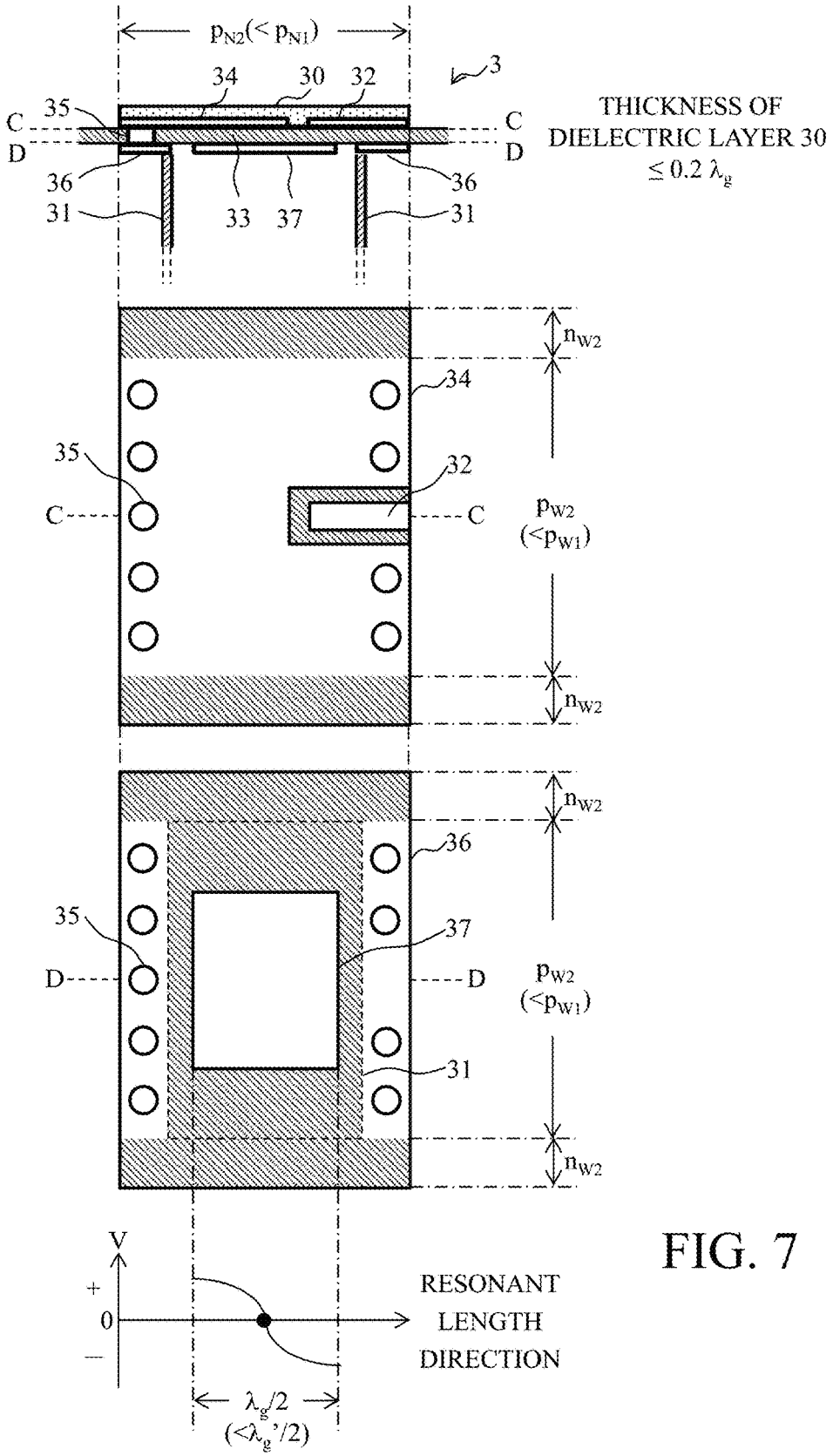
FIG. 7 is a diagram illustrating a structure of a waveguide/transmission line converter according to a second embodiment.

FIG. 7 illustrates a structure of a waveguide/transmission line converter according to a second embodiment. An uppermost view illustrates a side-sectional view of a waveguide/transmission line converter 3 (showing a size $p_{N2}$ in a direction along the cross-section of the narrow wall of the waveguide 31, which size $p_{N2}$ is smaller than the size $p_{N1}$ shown in FIGS. 3*a* and 3*b*). A second view illustrates a plan-sectional view taken along an arrow C-C of the waveguide/transmission line converter 3. A third view illustrates a plan-sectional view taken along an arrow D-D of the waveguide/transmission line converter 3. A lowest view illustrates electric field distribution (along the vertical axis referencing potential "V" ranging from negative "−" to positive "+") in a resonant length direction (i.e., horizontal axis) of a matching element 37 to be described later.

The waveguide/transmission line converter 3 includes a dielectric substrate 33, a short-circuit metal layer 34, a metal member 35, a ground metal layer 36, a matching element 37, and a dielectric layer 30 in order to convert power transmitted by a waveguide 31 and power transmitted by a transmission line 32 to each other.

The waveguide 31, transmission line 32, dielectric substrate 33, short-circuit metal layer 34, metal member 35, ground metal layer 36, and matching element 37 of the second embodiment in FIG. 7 are substantially similar to a waveguide 11, a transmission line 12, a dielectric substrate 13, a short-circuit metal layer 14, a metal member 15, a ground metal layer 16, and a matching element 17 of a first embodiment in FIG. 3*a*, respectively.

The matching element 37 is arranged on a surface of the dielectric substrate 33 and inside the waveguide 31, and electromagnetically coupled to the transmission line 32 via the dielectric substrate 33, in which a resonant length (approximately $\lambda_g/2$ which is less than $\lambda_g'/2$ as shown in FIG. 7) adapted to set up, as a standing wave, an electromagnetic wave having an effective wavelength $\lambda_g$ (to be described later together with the dielectric layer 30) in a surrounding environment of the matching element 37 is in an electric field direction inside the waveguide 31 and in a feed power direction of the transmission line 32.

The dielectric layer 30 is formed in contact with or close to surfaces of the transmission line 32 and of the short-circuit metal layer 34. Therefore, in the second embodiment, compared to the first embodiment, an effective dielectric constant in the surrounding environment of the waveguide/transmission line converter 3 can be increased and the effective wavelength $\lambda_g$ of an electromagnetic wave in the surrounding environment of the waveguide/transmission line converter 3 can be shortened, and sizes $p_{N2}$ and $p_{W2}$ in a direction along cross-sections of a narrow wall and a wide wall of the waveguide 31 can be reduced.

The dielectric layer 30 desirably has a thickness of 0.2 times or less of the effective wavelength $\lambda_g$ of the electromagnetic wave in the surrounding environment of the waveguide/transmission line converter 3. Accordingly, in order to cover a region where an electric field may leak from the dielectric substrate 33 between the transmission line 32 and the matching element 37, the dielectric layer 30 is required to have only a minimal thickness. Additionally, even when the dielectric layer 30 having the minimal thickness (0.2 times or less of $\lambda_g$) is formed in a millimeter wave application in which a thickness (about 0.5 mm or less) of the dielectric substrate 33 is reduced, structural strength of the waveguide/transmission line converter 3 can be increased, and a size of the waveguide/transmission line converter 3 can be reduced. In the description for FIG. 7, the dielectric layer 30 is formed only on the surfaces of the transmission line 32 and the short-circuit metal layer 34. As a modified example of FIG. 7, the dielectric layer 30 may be formed on an entire surface of the dielectric substrate 33.

Third Embodiment

Figure 8:
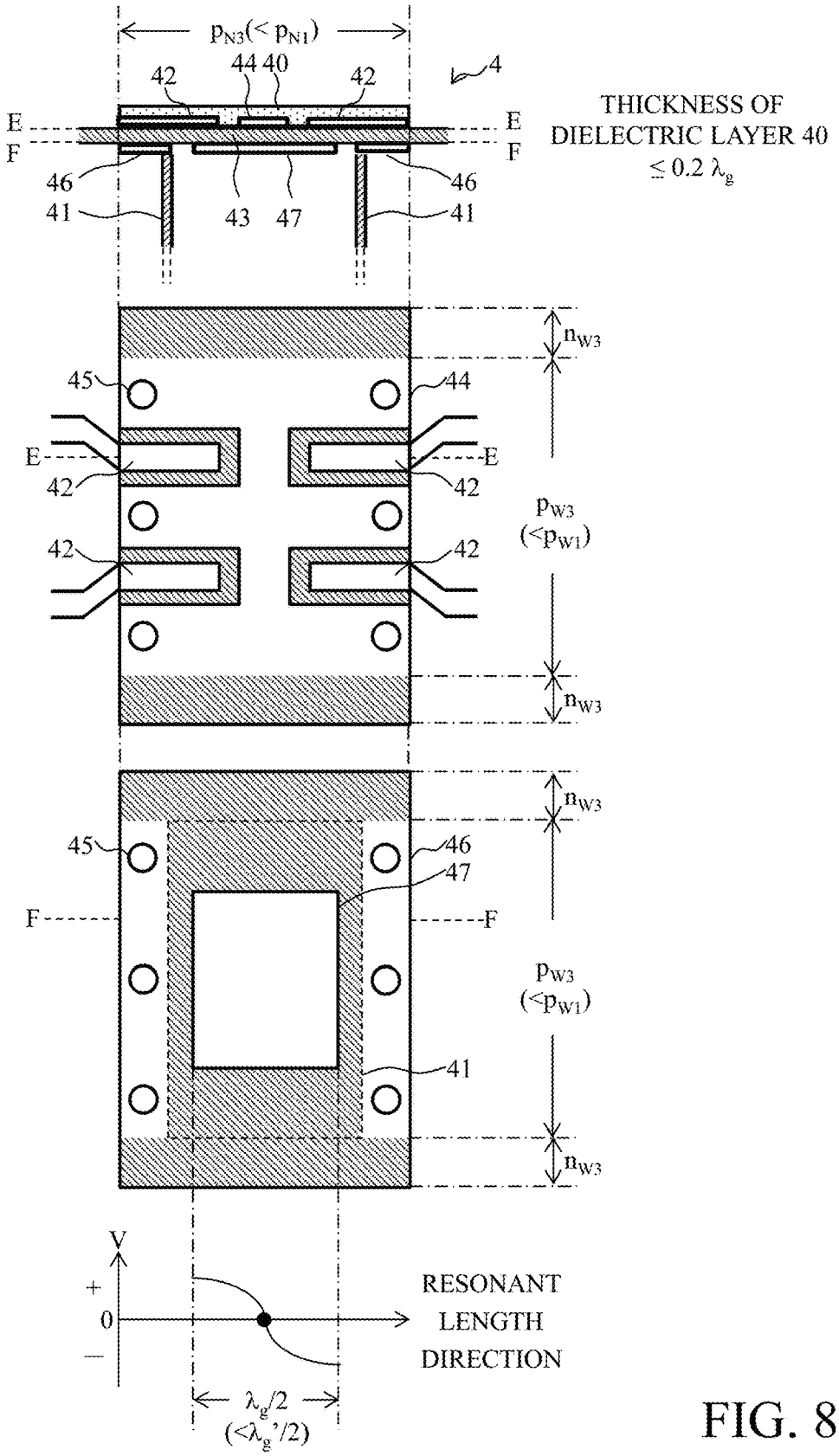
FIG. 8 is a diagram illustrating a structure of a waveguide/transmission line converter according to a third embodiment.

FIG. 8 illustrates a structure of a waveguide/transmission line converter according to a third embodiment. An uppermost view illustrates a side-sectional view of a waveguide/transmission line converter 4. A second view illustrates a plan-sectional view taken along an arrow E-E of the waveguide/transmission line converter 4. A third view illustrates a plan-sectional view taken along an arrow F-F of the waveguide/transmission line converter 4 (showing a size $p_{N3}$ in a direction along the cross-section of the narrow wall of the waveguide 41, which size $p_{N3}$ is smaller than the size $p_{N1}$ shown in FIGS. 3*a* and 3*b*). A lowest view illustrates electric field distribution (along the vertical axis referencing potential "V" ranging from negative "−" to positive "+") in a resonant length direction (i.e., horizontal axis) of a matching element 47 to be described later.

The waveguide/transmission line converter 4 includes a dielectric substrate 43, a short-circuit metal layer 44, a metal member 45, a ground metal layer 46, a matching element 47, and a dielectric layer 40 having a thickness less than 0.2 $\lambda_g$ in order to convert power transmitted by a waveguide 41 and power transmitted by a transmission line 42 to each other.

The waveguide 41, transmission line 42, dielectric substrate 43, short-circuit metal layer 44, metal member 45, ground metal layer 46, matching element 47, dielectric layer 40, sizes $p_{N3}$ and $p_{W3}$, an effective wavelength $\lambda_g$, and resonant length $\lambda_g/2$ which is less than $\lambda_g'/2$ in the third embodiment in FIG. 8 are substantially similar to a waveguide 31, a transmission line 32, a dielectric substrate 33, a short-circuit metal layer 34, a metal member 35, a ground metal layer 36, a matching element 37, a dielectric layer 30, sizes $p_{N2}$ and $p_{W2}$, an effective wavelength $\lambda_g$, and resonant length $\lambda_g/2$ in the second embodiment in FIG. 7, respectively.

In the description for FIG. 8, each two transmission lines 42 extend in both directions out of two opposite directions away from the waveguide/transmission line converter 4 along a resonant length direction of the matching element 47. As a modified example of FIG. 8, a plurality of transmission lines 42 may extend in one direction while a single or a plurality of transmission lines 42 may extend in another direction, out of the two opposite directions away from the waveguide/transmission line converter 4 along the resonant length direction of the matching element 47.

Thus, antennas can be arrayed in a direction perpendicular to a feed power direction only with one waveguide/transmission line converter 4, and high degree of freedom is provided to performance of an array antenna.

Figure 9:
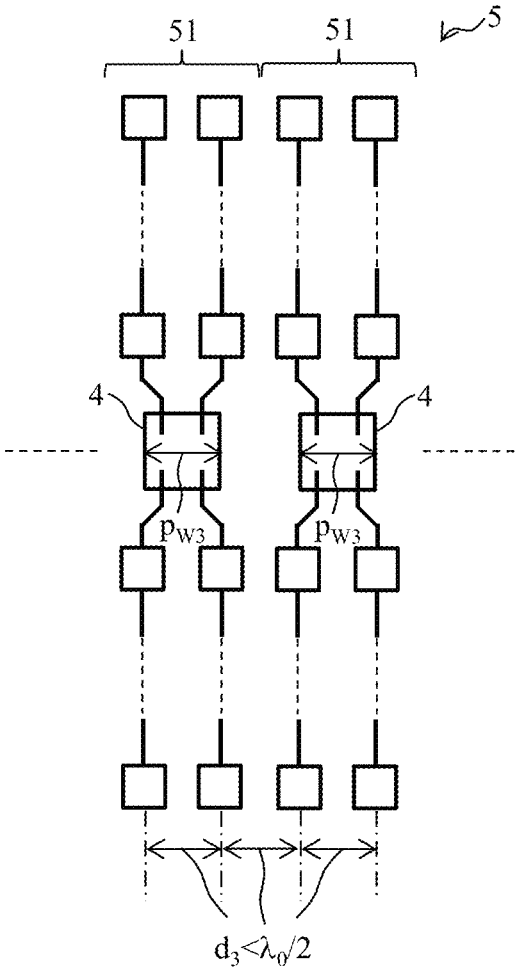
FIG. 9 is a diagram illustrating a structure of an antenna device according to the third embodiment.
Figure 10:
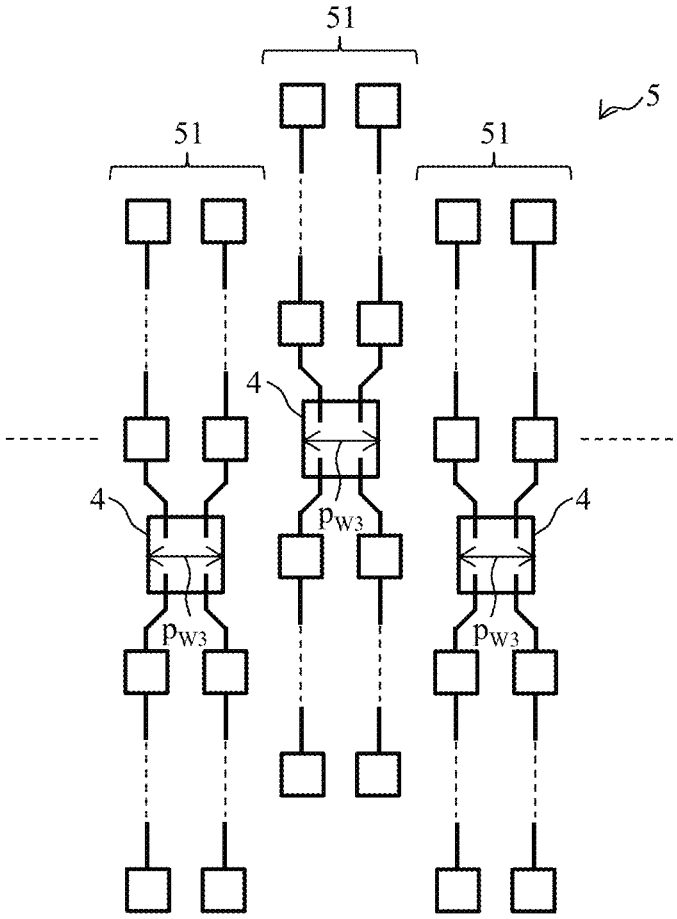
FIG. 10 is a diagram illustrating a structure of the antenna device according to the third embodiment.

FIGS. 9 and 10 illustrate structures of an antenna device according to the third embodiment. In an antenna device 5, antenna elements are arranged in a lattice shape on a plane. In FIG. 9, the waveguide/transmission line converter 4 is arranged on a straight line in a horizontal direction of the drawing. In FIG. 10, the waveguide/transmission line converter 4 is arranged in a staggered manner in the horizontal direction of the drawing. The antenna elements arranged in a lattice shape are divided per antenna elements 51 in every two columns. The antenna elements 51 in every two columns are fed power from the each two transmission lines 42 which are connected to the waveguide/transmission line converter 4 arranged in a center of every two columns and respectively extend in opposite directions (described in FIG. 8 as the third embodiment). The dielectric substrate 43 (shown in FIG. 8) is a plane on which the antenna elements are arranged in a lattice shape. A cross-section of a wide wall of the waveguide 41 (shown in FIG. 8) is arranged in a direction perpendicular to a direction of every two columns. A cross-section of a narrow wall of the waveguide 41 (shown in FIG. 8) is arranged in a direction parallel to the direction of every two columns.

Here, in the waveguide/transmission line converter 4, the size $p_{W3}$ (refer to FIG. 8) in a direction along the cross-section of the wide wall of the waveguide 41 out of sizes of patterns arranged on the surface of the dielectric substrate 43 can be reduced by a removal width $2n_{W3}$ or $n_{W3}$ (refer to FIG. 8) of the metal member 45 and the ground metal layer 46 which have been removed along cross-sections of both or a cross-section of one of the two narrow walls of the waveguide 41. Specifically, compared to a size $p_W'$ in FIG. 1, the size $p_{W3}$ in FIG. 8 is about ⅔ of the size $p_w'$ (i.e., $<p_w'$) for millimeter wave applications in which a size of the metal member 45 (shown in FIG. 8) cannot be ignored. Therefore, in the antenna device 5, a distance $d_3$ between the antenna elements in the respective columns adjacent to each other can be made narrower than a length $\lambda_0/2$ that is equal to half a wavelength $\lambda_0$ of a radiated electromagnetic wave, as evident from FIG. 9.

INDUSTRIAL APPLICABILITY

The waveguide/transmission line converter and the antenna device according to the present disclosure are applicable for a purpose of reducing in size, at low cost, an antenna device in which, as a result of synthesis, directivity having high gain in one arbitrary direction and in a wide frequency range can be formed, grating lobe is mostly eliminated, and antenna elements are arranged in a lattice on a plane.

REFERENCE SIGNS LIST

1, 3, 4, 1': Waveguide/transmission line converter
2, 5, 2': Antenna device
30, 40: Dielectric layer
11, 31, 41, 11': Waveguide
12, 32, 42, 12': Transmission line
13, 33, 43, 13': Dielectric substrate
14, 34, 44, 14': Short-circuit metal layer
15, 35, 45, 15': Metal member
16, 36, 46, 16': Ground metal layer
17, 37, 47, 17': Matching Element
21, 51, 21': Antenna elements in each column

What is claimed is:

1. A waveguide/transmission line converter configured to convert power transmitted by a waveguide and power transmitted by at least one transmission line to each other, the waveguide/transmission line converter comprising:

the waveguide having two wide walls and two narrow walls;

a dielectric substrate arranged in a manner blocking an opening of the waveguide;

a short-circuit metal layer arranged on a surface of the dielectric substrate and outside of the waveguide, and held at a potential which is the same as a potential of the waveguide either by a metal member penetrating the dielectric substrate along cross-sections of the two wide walls of the waveguide and not along cross-sections of the two narrow walls of the waveguide or by a metal member penetrating the dielectric substrate along the cross-sections of the two wide walls and a cross-section of one of the two narrow walls of the waveguide and not along a cross-section of the other of the two narrow walls of the waveguide; and a matching element arranged on a surface of the dielectric substrate and inside the waveguide, coupled to the transmission line, and having a resonant length in an electric field direction inside the waveguide and in a feed power direction of the transmission line, wherein the resonant length is adapted to set up, as a standing wave, an electromagnetic wave transmitting the power transmitted by the waveguide and having an effective wavelength in a surrounding environment of the dielectric substrate.

2. The waveguide/transmission line converter according to claim 1, further comprising a dielectric layer formed on surfaces of the transmission line and the short-circuit metal layer.

3. The waveguide/transmission line converter according to claim 2, wherein the dielectric layer has a thickness of 0.2 times or less of an effective wavelength of an electromagnetic wave transmitting the power transmitted by the transmission line in the surrounding environment of the waveguide/transmission line converter.

4. The waveguide/transmission line converter according to claim 3, wherein the power is transmitted by a plurality of transmission lines extending in at least one of two opposite directions away from the waveguide/transmission line converter along a resonant length direction of the matching element.

5. An antenna device having a plurality of antenna elements arranged in a lattice shape on a plane, wherein the plurality of antenna elements arranged in a lattice shape are divided into a plurality of antenna elements arranged in columns, the power is fed to the plurality of antenna elements arranged in each column by the transmission line connected to the waveguide/transmission line converter according to claim 4 arranged in a center of each column, the dielectric substrate is the plane on which the plurality of antenna elements are arranged in the lattice shape, cross-sections of the two wide walls of the waveguide are arranged in a direction perpendicular to each column, and cross-sections of the two narrow walls of the waveguide are arranged in a direction parallel to each column.

6. An antenna device having a plurality of antenna elements arranged in a lattice shape on a plane, wherein the plurality of antenna elements arranged in a lattice shape are divided into a plurality of antenna elements arranged in columns, the power is fed to the plurality of antenna elements arranged in each column by the transmission line connected to the waveguide/transmission line converter according to claim 3 arranged in a center of each column, the dielectric substrate is the plane on which the plurality of antenna elements are arranged in the lattice shape, cross-sections of the two wide walls of the waveguide are arranged in a direction perpendicular to each column, and cross-sections of the two narrow walls of the waveguide are arranged in a direction parallel to each column.

7. An antenna device having a plurality of antenna elements arranged in a lattice shape on a plane, wherein the plurality of antenna elements arranged in a lattice shape are divided into a plurality of antenna elements arranged in columns, the power is fed to the plurality of antenna elements arranged in each column by the transmission line connected to the waveguide/transmission line converter according to claim 2 arranged in a center of each column, the dielectric substrate is the plane on which the plurality of antenna elements are arranged in the lattice shape, cross-sections of the two wide walls of the waveguide are arranged in a direction perpendicular to each column, and cross-sections of the two narrow walls of the waveguide are arranged in a direction parallel to each column.

8. The waveguide/transmission line converter according to claim 2, wherein the power is transmitted by a plurality of transmission lines extending in at least one of two opposite directions away from the waveguide/transmission line converter along a resonant length direction of the matching element.

9. An antenna device having a plurality of antenna elements arranged in a lattice shape on a plane, wherein the plurality of antenna elements arranged in a lattice shape are divided into a plurality of antenna elements arranged in columns, the power is fed to the plurality of antenna elements arranged in each column by the transmission line connected to the waveguide/transmission line converter according to claim 8 arranged in a center of each column, the dielectric substrate is the plane on which the plurality of antenna elements are arranged in the lattice shape, cross-sections of the two wide walls of the waveguide are arranged in a direction perpendicular to each column, and cross-sections of the two narrow walls of the waveguide are arranged in a direction parallel to each column.

10. An antenna device having a plurality of antenna elements arranged in a lattice shape on a plane, wherein the plurality of antenna elements arranged in a lattice shape are divided into a plurality of antenna elements arranged in columns, the power is fed to the plurality of antenna elements arranged in each column by the transmission line connected to the waveguide/transmission line converter according to claim 1 arranged in a center of each column, the dielectric substrate is the plane on which the plurality of antenna elements are arranged in the lattice shape, cross-sections of the two wide walls of the waveguide are arranged in a direction perpendicular to each column, and cross-sections of the two narrow walls of the waveguide are arranged in a direction parallel to each column.

11. The waveguide/transmission line converter according to claim 1, wherein the power is transmitted by a plurality of transmission lines extending in at least one of two opposite directions away from the waveguide/transmission line converter along a resonant length direction of the matching element.

12. An antenna device having a plurality of antenna elements arranged in a lattice shape on a plane, wherein the plurality of antenna elements arranged in a lattice shape are divided into a plurality of antenna elements arranged in columns, the power is fed to the plurality of antenna elements arranged in each column by the transmission line connected to the waveguide/transmission line converter according to claim 11 arranged in a center of each column, the dielectric substrate is the plane on which the plurality of antenna elements are arranged in the lattice shape, cross-sections of the two wide walls of the waveguide are arranged in a direction perpendicular to each column, and cross-sections of the two narrow walls of the waveguide are arranged in a direction parallel to each column.

* * * * *